US005242083A

United States Patent [19]

Christine et al.

[11] Patent Number: 5,242,083

[45] Date of Patent: Sep. 7, 1993

[54] LIQUID DISPENSING SYSTEM HAVING A LIQUID RESERVOIR

[75] Inventors: William C. Christine, Nazareth; Scott A. Roth, Danielsville, both of Pa.

[73] Assignee: Inpaco Corporation, Nazareth, Pa.

[21] Appl. No.: 826,065

[22] Filed: Jan. 27, 1992

[51] Int. Cl.[5] ..... B65D 35/54

[52] U.S. Cl. ..... 222/96; 222/105; 222/185; 222/214; 222/511

[58] Field of Search ..... 222/94, 96, 105, 106, 222/181, 182, 185, 207, 209, 212, 213, 214, 448–452, 491, 511, 506; 251/7, 9, 10

[56] References Cited

U.S. PATENT DOCUMENTS

| | | | |
|---|---|---|---|
| 2,772,817 | 12/1956 | Jauch | 222/207 |
| 3,066,832 | 12/1962 | Rossetti | 222/207 |
| 3,870,201 | 3/1975 | Asplund | 222/207 |
| 4,286,733 | 9/1981 | Weikert | 222/511 X |
| 4,349,133 | 9/1982 | Christine | 222/183 |
| 4,463,876 | 8/1984 | Swallert | 222/94 |
| 4,546,904 | 10/1985 | Frassanito | 222/185 |
| 4,570,827 | 2/1986 | Roggenburg, Jr. et al. | 222/95 |
| 4,570,829 | 2/1986 | Allen | 222/207 X |
| 4,667,854 | 5/1987 | McDermott et al. | 222/101 |
| 4,932,562 | 6/1990 | Christine | 222/96 |
| 5,016,779 | 5/1991 | Williamson | 222/105 X |

FOREIGN PATENT DOCUMENTS 693485 6/1940 Fed. Rep. of Germany ..... 222/214

*Primary Examiner*—Andres Kashnikow
*Assistant Examiner*—Anthoula Pomrening
*Attorney, Agent, or Firm*—Hill, Steadman & Simpson

[57] ABSTRACT

A liquid dispensing system providing a housing holding a liquid filled pouch inside, the housing pivotably supporting an actuating arm which is thrust against the pouch by a push button extending outside the housing, the actuating arm having an actuator to compress an upper section of a tubular peristaltic pump section of the pouch for squeezing out an incremental amount of liquid. The tubular peristaltic pumping section provides V-shaped notches arranged on lateral sides of the top section and the bottom section for ease of closure by flattening and other advantages. A check valve having lever arms to resiliently stretch flat a discharge nozzle section at the lower end of the peristaltic pumping tube prevents dripping during non-use. A check valve actuator is provided on the actuating arm to engage with the check valve lever arms to open the discharge nozzle during actuation and a short time thereafter to create a suck-back to remove any drips.

27 Claims, 4 Drawing Sheets

A
72
260
302
300
178
B 72
260
178

166
34
170
166
28a
28b
32
232
230
166
166
40
172
216
204
200
206
206
136
250
62
64
138

120
108
108
126
128
62
64
64
106
116
118
138
136
280a
262a
282a
290
262b
292

LIQUID DISPENSING SYSTEM HAVING A LIQUID RESERVOIR

BACKGROUND OF THE INVENTION

The present invention relates to a liquid dispensing system, particularly to a soap dispensing cabinet wherein incremental amounts of soap can be dispensed in response to actuation by a user.

A number of liquid soap dispensers are known. U.S. Pat. No. 4,349,133, U.S. Pat. No. 4,546,904, U.S. Pat. No. 4,667,854 and U.S. Pat. No. 4,463,876 are examples of such dispensers.

U.S. Pat. No. 4,349,133 discloses a liquid dispenser and refill package. The dispenser has a housing, flexible plastic pouch, pumping mechanism and a check valve mechanism. The housing provides a front half and a rear half joined together by a hinge. A pouch located within the housing includes a reservoir and a tubular pumping section in fluid communication with the reservoir.

A "duck bill" check valve for preventing liquid leakage from the pumping section is located at the free end of the pumping section of the pouch. In FIG. 6 of U.S. Pat. No. 4,349,133, the "duck bill" check valve is illustrated. The "duck bill" valve is a plastic cylindrical closure having a diametric slit thereacross which is normally closed but openable when the liquid is pressurized by the pump. The pumping mechanism is contained within the housing and comprises a first block and a second block which sandwich the pumping section and squeeze the pumping section when forced together. The second block is mounted on a lever hinged to the housing. The lever actuates the pumping mechanism when grasped and pulled forward.

U.S. Pat. No. 4,546,904 is similar to U.S. Pat. No. 4,349,133. A check valve is provided in this device. The check valve can comprise one of two embodiments: a first embodiment is a ball and spring valve (see FIG. 5); and a second embodiment is a slit diaphragm valve (see FIG. 4).

U.S. Pat. No. 4,667,854 discloses a liquid dispenser having a roller which travels along the length of the pumping section. A check valve is provided which comprises a nozzle which has a small opening.

U.S. Pat. No. 4,463,876 discloses a pouch liquid dispenser system having a reservoir section, a pumping section, and a discharge nozzle.

U.S. Pat. No. 4,932,562, which names one of the two inventors of the instant invention as an inventor, discloses a liquid dispensing system. The system includes a compressible housing holding a flexible pouch therein for storing liquid such as soap. A valve mechanism for checking the flow of the liquid from the pouch is provided that includes a mechanism for laterally tensioning the pouch proximate its discharge nozzle.

Although the prior dispensers provide apparatus that can be used to dispense a liquid, such as soap, they suffer a number of disadvantages.

A number of the systems are unnecessarily complex in structure and operation. As a result, these systems are difficult and expensive to manufacture and maintain.

Additional limitations with respect to some dispensers include a slow response (rate of product flow) of the pump section refilling with fluids; a failure of the system to sufficiently "suck-back" fluid at the conclusion of the discharge stroke; and wear and tear on the tube section due to the need to achieve an absolute shut off of the supply side of the fluid system.

SUMMARY OF THE INVENTION

The present invention overcomes the disadvantages of prior liquid dispensers. To this end, the present invention provides an apparatus for dispensing incremental liquid portions from a liquid reservoir comprising a film pouch, such as a polymeric bag, having a supply section or reservoir section at a top portion thereof. Liquid flows by gravity from the reservoir section into a tubular section or pump section of the pouch. The pump section terminates in a discharge nozzle section which has an aperture at a terminal end thereof. Engagement formations such as holes are arranged on opposite lateral sides of the discharge nozzle section.

The pouch is suspended in a vertical orientation within a housing. An actuating arm is provided which is pivotally mounted within the housing. The actuating arm includes an impact portion that is designed to contact a top portion of the tubular section when the actuating arm is pivoted toward the pouch.

A lower check valve, mounted with respect to the framework, has two lever arms arranged laterally spaced apart and each arm is engageable respectively with one of the engagement formations of the pouch. The lever arms are biased away from each other, at the engagement formations, to effectively stretch flat the discharge nozzle section of the pouch to close the aperture. A check valve actuator, mounted for movement with the actuating arm, is provided which has two cammed surfaces, each arranged to impact one of the lever arms respectively. Pivoting of the actuating arm toward the pouch engages the cams against the lever arms to force the lever arms toward each other which relaxes the nozzle section and effectively opens the aperture.

It is an advantage of the present invention that the apparatus increases the response rate for refilling the pump section or tubular section of the liquid bag after discharge of liquid from the dispenser. As the viscosity of the dispensed liquid increases, the refill or recovery of the pump section after an amount is dispensed is slower. Difficult recovery has been experienced with very viscous or gel-like products.

The present invention overcomes the problems of the prior art by adding a section of injection molded tubular-shaped polymer to the bag in the pump section, secured to the polymeric film of the pouch. Additionally, variations to the pump tube configuration provide a selectable range of advantageous responses.

For easy closing at the upper end, to effect a check valve function, "V" shaped notches are provided at locations spaced 180° apart to each other and on lateral sides of the pump section. These notches reduce the pump actuation force while allowing total shut off. Alternately, slits formed at 180° in lieu of the "V" notches, located in the same described areas, can be provided. These slits require more force to close but require less stroke than the "V" shaped notches.

Thickness in the pumping section can be varied to increase or decrease "memory" or refilling response rate. A thicker tube consequently increases system suction during the return stroke and conversely requires more force. Thicker walls can be used with fluids of higher viscosity which produces higher suction.

Variations in the shape of the discharge end of the sleeve can enhance or diminish the speed of discharge and the "memory" in the pump section.

The impact portion and lower check valve actuator can be formed of a single piece mounted to the actuating arm and referred to as a pump actuator.

As a further aspect of the invention, an improved lower check valve actuator is utilized which controls the operation of the lower check valve in the manner which will provide a controlled amount of "suck-back" (described below) after discharging of the fluid.

An important part of the dispenser function is to provide a "suck-back" characteristic immediately upon conclusion of the discharge stroke or compression of the pump mechanism. This phenomenon eliminates the possibility of a drip, or a non-clean cut-off of the fluid discharge.

In order to inventively achieve this advantage the lower check valve actuator is mounted to the actuating arm which will cause a delay of the closing of the lower check valve, during retraction of the actuating arm, by restricting the action of the lever arms which stretch closed the discharge port. Tensioning pins are used as the lever arms.

The lower check valve actuator provides cams which interact with the tensioning pins of the lower check valve. The lower check valve actuator can be adjusted for extent and duration of check valve opening within the pumping cycle. Hence, when the discharge port is held open for more or less time by the lower check valve as a return stroke of the actuating arm begins, correspondingly more or less of the suction created by the pump tube will be used to create "suck-back" at the aperture to atmosphere.

When the tensioning pins are released from the effect of the lower check valve actuator cams, the full suction of the pump section tube is exerted upon the fluid in the reservoir. This lower check valve actuator can be adjusted to be responsive to a variety of fluids by positioning the cams to move the tensioning pins of the lower check valve more or less duration and at a sooner or later interval in the cycle of operations. A second benefit of this lower check valve actuator is that by containing the tensioning pins during the discharge part of the cycle, a reduced operating force is derived. Also, since the lower check valve actuator can comprise a double cam formed on the pump actuator and since this part is injection molded, an extra component is not required; however, a separate piece check valve actuator mounted to the actuating arm is possible.

An additional advantage of the present invention is to provide a method for reliably and at a low force performing the function of an upper check valve without using a dual or compound actuation mechanism, e.g., using two elements sequentially, one closing the pump tube and the other squeezing the tube to eject the fluid from the tube.

A known manner of achieving an upper check valve function in a tubular peristaltic pumping system is to mechanically squeeze the tube shut. Most mechanisms use this technique. In peristaltic pumping, in order to achieve the absolute shut off from the supply side of the fluid system, in a single component mechanism, the customary technique involves a relatively sharp edge projection on the pump actuator being advanced against the tube ahead of the face of the pump actuator which squeezes the section of the tube containing the fluid to be discharged. However, this method is abusive of the tube, and inefficient as to energy usage, since the actuator must be sufficiently deflected to allow it to be stroked forward of its check valve or closed position into its pumping or fluid discharging position.

One actuator of the system of the present invention has several features which achieve these inventive advantages. As the pump actuator arm is advanced in a predetermined arcuate motion in the performance of the dispensing function, the portion of the pump actuator arm at its upper end, described as the upper check valve actuator tip portion, progressively engages and compresses the upstream end of the pump tube against a "pump anvil" projection on the dispenser back molding. The progressive engagement involves slidably engaging the contoured surfaces of the anvil and the tip in a manner which utilizes the physical properties of the polymer that is used to mold the actuator (high memory, low set retention) and the contoured shapes of the two parts in a rolling, wedging effect, rather than a knife effect. Because of the engagement, a reduced resistance to the closing of the pump sleeve is achieved by the unique notching at the point of engagement with the tip and anvil.

Reduced resistance at the downstream end of the pump sleeve is also achieved by notching this end. By using a "V" notching and altering the length of the rear flap to increase length so that it is equal to that of the front flap, recovery and suck-back is increased along with back pressure and consequent operating force. By decreasing the rear flap length this results in decreased recovery and suck-back while also decreasing back pressure and consequent operating force.

In another embodiment of the invention, a specially shaped actuator with a replaceable adjustable pressure pad is provided. The lower check valve actuator cams can also be provided integral with this actuator at its lower extremity. The cams actuate the lower check valve pins to open the lower check valve during operation.

In this embodiment it is not necessary to use an external transverse bar-shaped device to function as an upper check valve during the pressure stroke of the actuator. Additionally, the V-shaped notches at a top end of the pump sleeve can be preferably set to form a 60° included angle. The 60° notch reduces the force required to accomplish this closing and at the same time, when the pressure is released, the notch insures that as product drains down, the pump tube is able to make a complete evacuation of the reservoir section of the pouch.

Additional features and advantages of the present invention are described in, and will be apparent from, the detailed description of the presently preferred embodiments.

DETAILED DESCRIPTION OF THE PRESENTLY PREFERRED EMBODIMENTS

Figure 1:
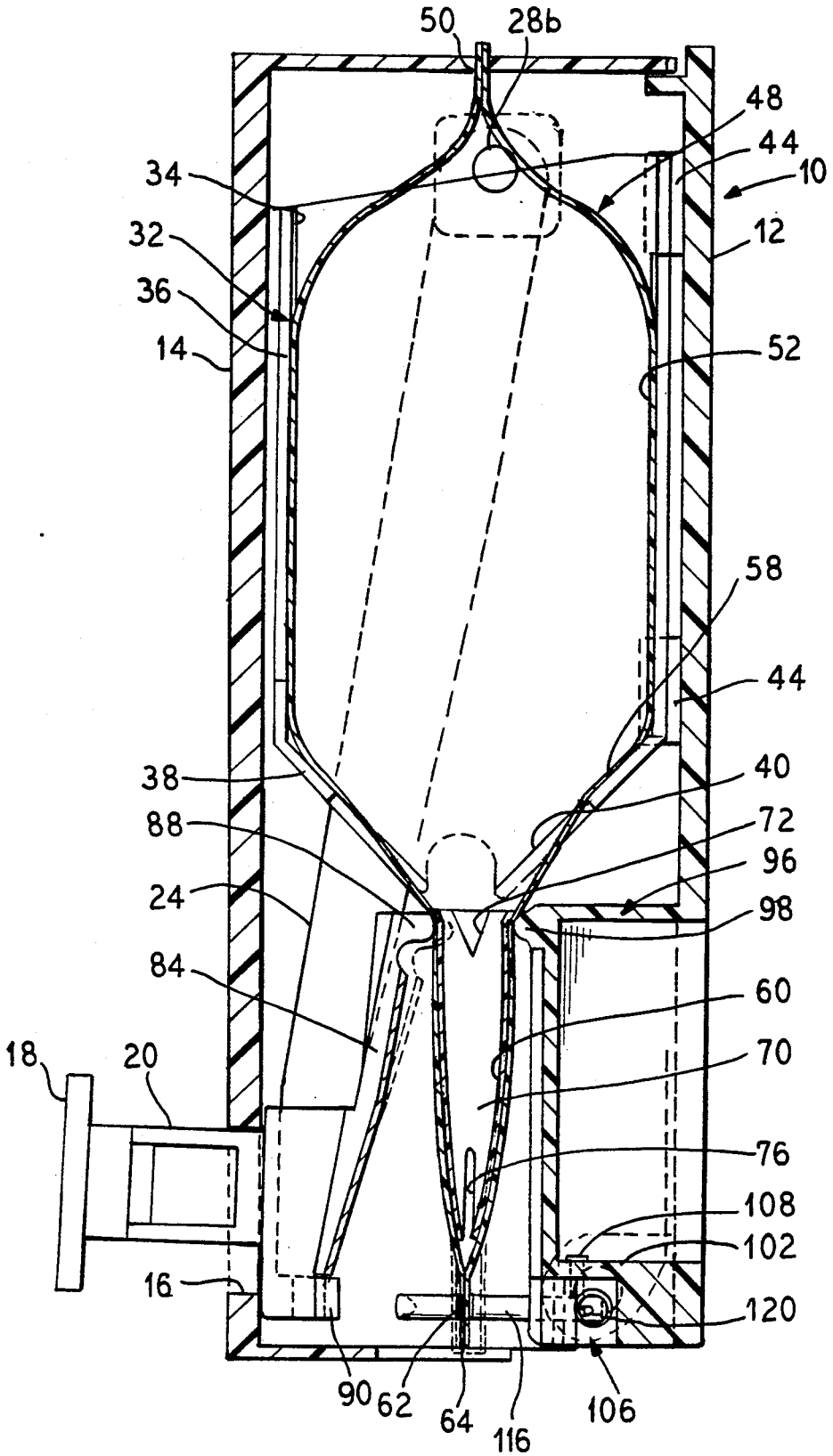
FIG. 1 is a longitudinal sectional view of a first embodiment of the present invention.

Referring to the figures, and specifically FIG. 1 an embodiment of the liquid dispenser is illustrated. As illustrated the dispenser 10 includes a back plate 12 which typically is attached to a wall or other structure to support the dispenser 10 in a known way. The back plate 12 is effectively covered by a front cover 14 by suitable formations and/or screws.

The front cover 14 includes a window portion 16 therethrough. A push button 18 proceeds external of the front cover 14 through the window 16 and attaches to an actuating arm 24. The push button 18 is fixedly inserted into a socket 20 of the arm 24.

Figures 3, 5, 6, 7:
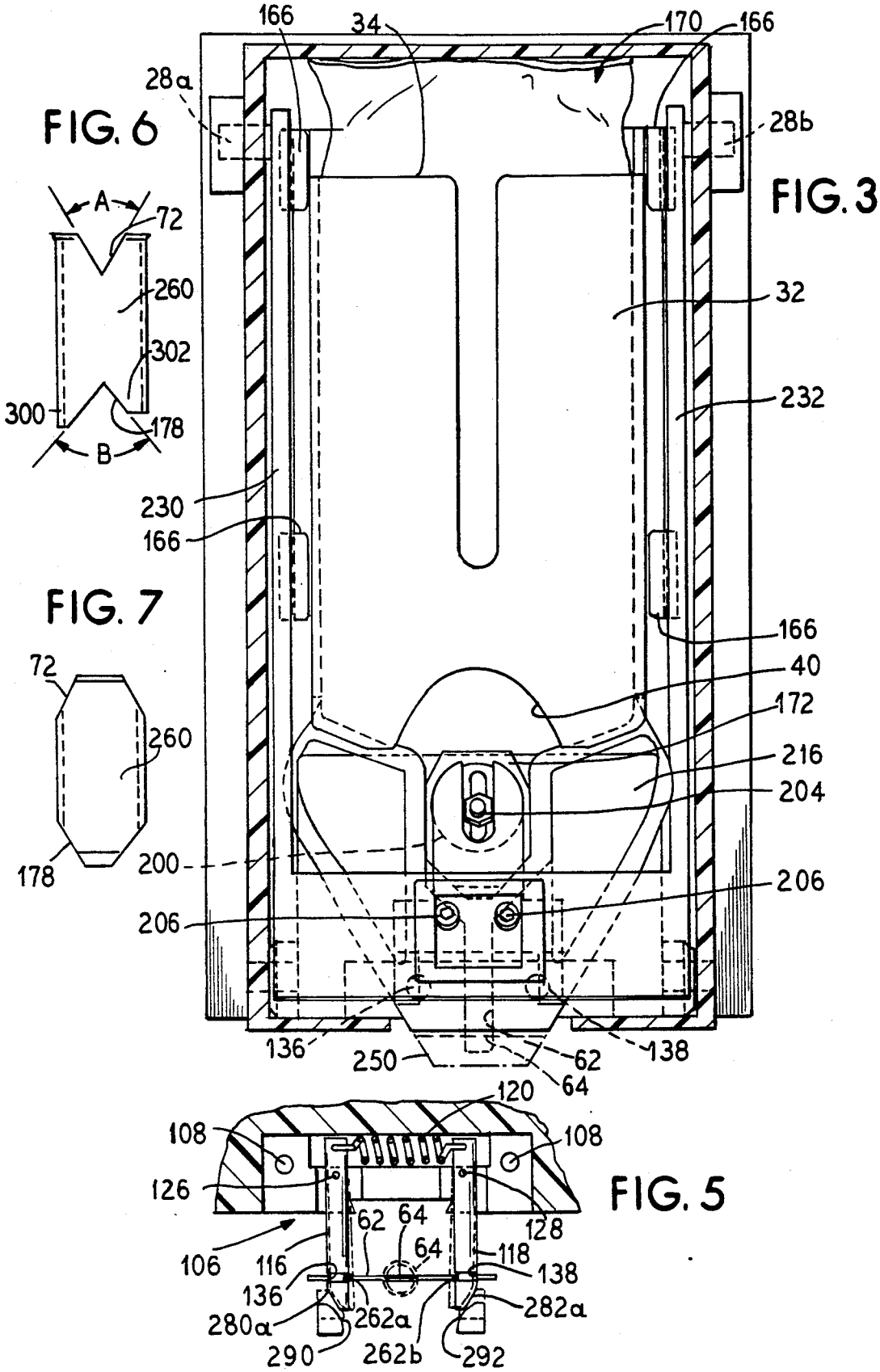
FIG. 3 is a sectional view taken generally along line III—III of FIG. 2.
FIG. 5 is a sectional view taken generally along V—V of FIG. 4.
FIG. 6 is a side elevational view of a pump tube shown in FIG. 2.
FIG. 7 is a front elevational view of the pump tube of FIG. 6.

The actuating arm 24 is pivotably connected to the front cover 14, near its top at pin connectors 28*a*, 28*b* (see FIG. 3). Inside the dispenser 10 between the front cover 14 and the back plate 12 is located an elongated conical trough 32 having a wide open top end 34, generally straight sides 36, a cone section 38 and a bottom opening 40. The trough 32 is supported in the dispenser by clips 44 attached to the back plate 12.

Placed within the trough 32 is a film pouch 48 having a sealed top end 50, a liquid containing volume or straight section 52, a generally conical section 58 below the straight section 52, and a cylindrical pathway 60 terminating in a narrow channel section 62 having an aperture 64 at its terminal end. Mounted within the cylindrical pathway 60 is a tube 70 having a sufficient thickness to retain a structural memory after collapsing. That is, the tube will spring back to its tubular shape after being compressed.

In an exemplary embodiment, the tube includes V-shaped notches 72 arranged laterally at a top end of the tube 60 and second V-shaped notches 76 arranged laterally at a bottom end of the tube. In FIG. 1 the second V-shaped notches 76 are shown somewhat flattened, this due to a tightly formed and flattened cylindrical pathway 60 of the film pouch 48.

The actuator arm 24 provides at its low end an actuator 84. The actuator 84 provides at a top end thereof a hammer or impact portion 88 and a check valve actuator 90 at a lower end thereof. The back plate 12 extends inwardly at a lower portion thereof into a raised formation 96 which is generally box-shaped having an anvil formation 98 proceeding toward the cylindrical pathway 60 arranged in front thereof.

The formation 96 provides a bottom wall 102. A lower check valve 106 is attached to the bottom wall 102 via pins 108. The check valve comprises two pins 116, 118 which act as lever arms (see FIG. 5). A spring 120 connects the pins 116, 118 at a base end thereof. The pins 116, 118 are pinned in a middle portion at pivot points 126, 128 respectively. The pins 116, 118 proceed from this middle portion through holes 136, 138 arranged in a nozzle portion of the film pouch.

Figure 1A:
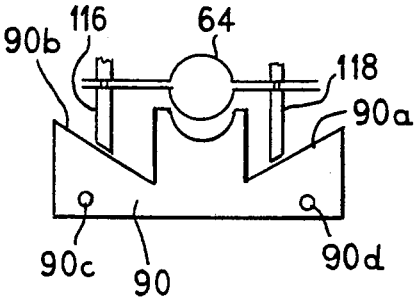
FIG. 1A is a bottom plan view of a check valve actuator from FIG. 1 in a dispensing condition.

The operation of the check valve actuator 90 is shown more clearly in FIG. 1A. As the actuating arm 24 approaches the pouch 48 the pins 116, 118 make contact with and slide down the inclined surfaces 90*a*, 90*b*. The pins 116, 118 are thus drawn together to relax the aperture 64 of the pouch 48. Holes 90*c*, 90*d* are provided to pin the actuator 90 to the actuating arm or to the impact portion 88 or it can be formed integral therewith.

Figure 2:
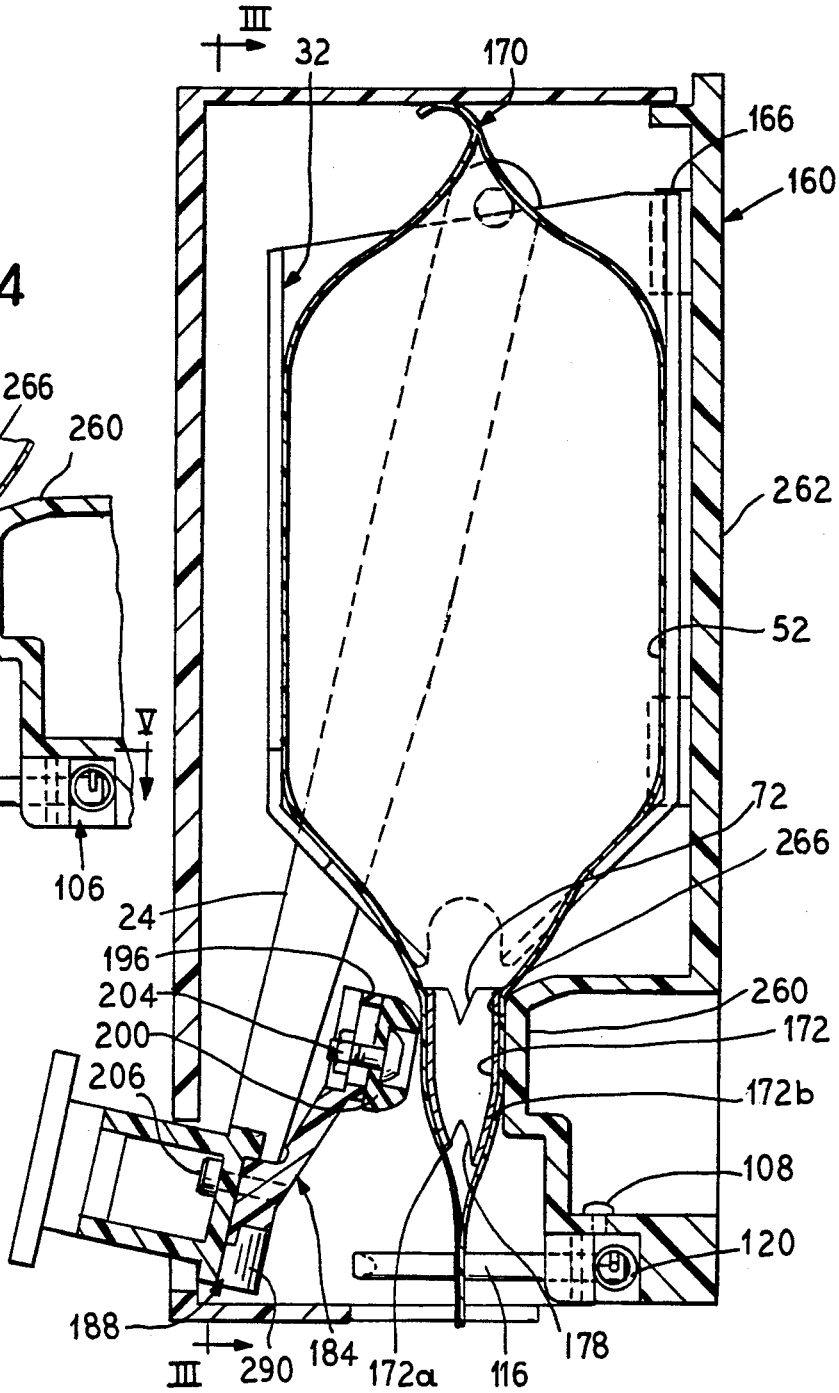
FIG. 2 is a longitudinal sectional view of a second embodiment of the present invention.

FIG. 2 illustrates another embodiment of the dispenser 10 described with regard to FIG. 1, referred to as dispenser 160. The trough 32 is supported within the dispenser 160 by a plurality of clips 166. A film pouch 170 is similar to the film pouch 48 except for a substantially shorter polymeric tube 172 located therein. In the embodiment shown in FIG. 2, the tube 172 provides V-shaped notches 72 at a top end thereof and notches 178 at a bottom end thereof. In the embodiment shown in FIG. 2, a front portion of the tube 172 has a shorter length than a rear portion 172*b*.

On a front side of the tube 172 mounted to the actuator arm 24 is an actuator 184. The actuator 184 provides a check valve actuator 188 arranged at a bottom end thereof and a hammer portion 196 at a top end thereof. The hammer portion 196 comprises a round compression member 200 bolted to the hammer portion 196 by bolt 204. The compression member 200 can be plastic, rubber or other material selected for hardness and compression (resiliency) to achieve an optimal squeezing effect against the tube 172. Because the compression member is bolted on, it can be readily changed depending on application. The actuator 184 is bolted to the actuator arm by bolts 206.

FIG. 3 illustrates the pouch 170 mounted into the trough 32 having the wide opening 34 at a top end thereof and the smaller opening 40 at a bottom end thereof. The conical bottom section of the pouch 216 extends below the trough 34 and includes engaging holes 136, 138 for receipt of pins 116, 118 of the check valve.

A bolt 204 is used to secure a round compression member 200 to the hammer portion 196. Bolts 206, as illustrated, secure the actuator 184 to the actuating arm 24. The actuating arm 24 is shown as being of a generally U-shaped configuration with parallel actuating levers 230, 232 pinned above at the pins 28*a*, 28*b*.

The pouch 170 also comprises a tear-off portion 250. When portion 250 is torn off, aperture 64 is exposed.

Figure 4:
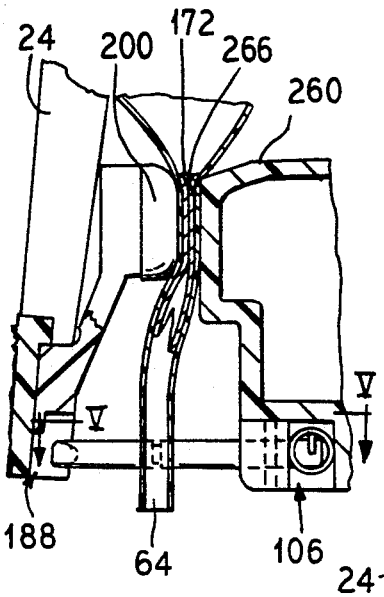
FIG. 4 is a partial sectional view from FIG. 2 showing the actuator in a dispensing condition.

FIG. 4 illustrates the operation of the actuator when activated by a user. The round compression member 200 has pivoted with the actuating arm 24 to strike and close the tube 172 against a formation 260 formed on a back plate 262. In the illustrated embodiment, an anvil is not needed, and a flat area 266 is arranged on the formation 260. The compression member 200 squeezes the tube 172 to flatten the tube between its V-shaped notches 72 to close the tube off from the straight section 52 and conical section 58. Simultaneously the compression member 200 squeezes an amount of fluid residing in the tube downward out through the aperture 64. Also, in this condition, the check valve 106 is now engaged by the check valve actuator 184 to assist in holding the aperture 64 open by compressing the narrow Channel 62 by moving the holes 136, 138 closer together.

FIG. 5 illustrates the functioning of the check valve 106. The pins 116, 118 are shown extended through the holes 136, 138 in the narrow channel section 62 of the pouch. The pins have annular slots 262*a*, 262*b* to hold the narrow channel section 62 thereon. The pins have distal ends 280, 282 with surfaces 280*a*, 282*a* tapered outwardly.

Before the check valve actuator 184 makes contact with the pins 116, 118, a spring 120 causes the pins 116, 118 to pivot about their pivot points 126, 128 to spread apart from each other at their distal ends 280, 282. This places tension on the narrow channel section 62 of the pouch to hold the aperture 64 closed. When cammed surfaces 290, 292 of the check valve actuator 188 approach and impact the distal ends of the pins 280, 282 the sliding cam action on the tapered outside surfaces 280*a*, 282*a* of the distal ends 280, 282 causes the pins to move toward each other against the bias of the spring 120 to open up the aperture 64 as shown in dashed lines of FIG. 5.

FIGS. 6 and 7 illustrate the tubular section 260 that is used in the present invention. V-shaped notches are formed both in the top section and the bottom section. In the preferred embodiment, the upper V-shaped notches 72 have an angle A=60°. At a bottom end thereof an angle B is provided for the V-shaped notches.

As also illustrated in FIG. 6 at a bottom end of the tube, a first arcuate side or "flap" 300 of the tube 172 is fashioned longer than a second arcuate side or "flap" 302 of the tube 172. The first arcuate side 300 can be arranged either on a side of the tube closest to the impacting hammer 196 (the front side) or on the side furthest away from the impacting hammer 196 (the back side). Depending on the orientation, different benefits are achieved.

One actuator of the system of the present invention has several features which achieve these inventive advantages. As the pump actuator arm is advanced in a predetermined arcuate motion in the performance of the dispensing function, the portion of the pump actuator arm at its upper end, described as the upper check valve actuator tip portion, progressively engages and compresses the upstream end of the pump tube against a "pump anvil" projection on the dispenser back molding. The progressive engagement involves slidably engaging the contoured surfaces of the anvil and the tip in a manner which utilizes the physical properties of the polymer that is used to mold the actuator (high memory, low set retention) and the contoured shapes of the two parts in a rolling, wedging effect, rather than a knife effect. Because of the engagement, a reduced resistance to the closing of the pump sleeve is achieved by the unique notching at the point of engagement with the tip and anvil.

Reduced resistance at the downstream end of the pump sleeve is also achieved by notching this end. By using a "V" notching and altering the length of the rear flap to increase length so that it is equal to that of the front flap, recovery and suck-back is increased along with back pressure and consequent operating force. By decreasing the rear flap length this results in decreased recovery and suck-back while also decreasing back pressure and consequent operating force.

Figure 8:
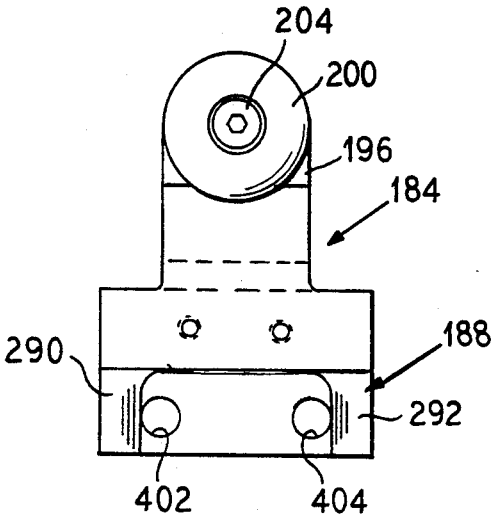
FIG. 8 is a front elevational view of a pump actuator shown in FIG. 2.
Figure 9:
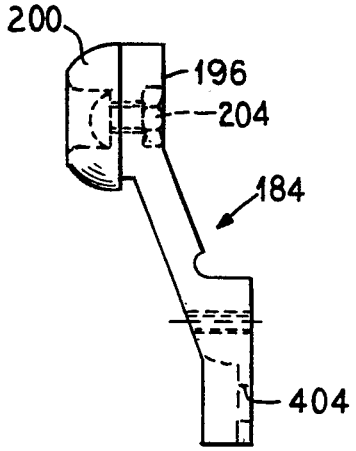
FIG. 9 is a right side elevational view of the pump actuator of FIG. 8.
Figure 10:
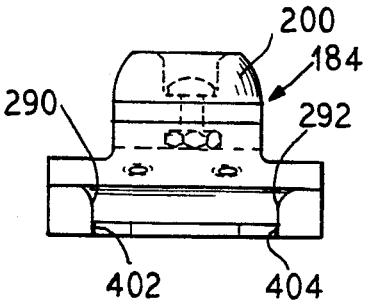
FIG. 10 is a bottom view of the pump actuator of FIG. 8.

FIGS. 8, 9 and 10 illustrate in more detail the actuator 184. The round compression member 200 is shown mounted to the hammer portion 196. The check valve actuator 188 is shown comprising cammed surfaces 290, 292 and additionally shows receiving apertures 402, 404. The receiving apertures 402, 404 are provided for the lower check valve pins 116, 118 to be able to pass therethrough during the compression stroke of the actuator 184 against the pouch 170. The receiving apertures 402, 404 hold the pins 116, 118 together at a predetermined separation. The pins 116, 118 thereby will slide across the cammed surfaces 290, 292 and into the receiving apertures 402, 404.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim as my invention:

1. An apparatus for dispensing incremental liquid portions from a liquid reservoir comprising:

a pouch having a liquid supply section, a tubular section fluidly connected to said liquid supply section, and a discharge nozzle section fluidly connected to said tubular section, said discharge nozzle section having an aperture at a terminal end thereof, and engagement formations arranged on opposite lateral sides of said discharge nozzle section;

a framework having means for supporting the pouch;

means for selectively compressing said tubular section to dispense said incremental liquid portion;

a lower check valve mounted with respect to said framework and having two lever arms arranged laterally spaced apart and each arm engageable respectively with one of said engagement formations of said pouch, said lever arms biased away from each other to stretch flat said discharge nozzle section for closure; and a check valve actuator, mounted for movement with said means for selectively compressing, said check valve actuator having two cammed surfaces each arranged to impact one of said lever arms respectively during selective compression of said tubular section, said two cammed surfaces engage said lever arms to force said lever arms toward each other.

2. The apparatus according to claim 1, wherein said tubular section comprises sufficient thickness to have structural memory to spring back after being at least partially collapsed.

3. The apparatus according to claim 2, wherein said tubular section comprises a tube member extending along at least a partial length of said tubular section and having a pair of V-shaped notches arranged at a bottom end thereof, arranged on opposite lateral sides.

4. The apparatus according to claim 3, wherein a front arcuate surface of said tube member on one side of said V-shaped notches is adapted to be longer than a rear arcuate surface of the tube member.

5. The apparatus according to claim 3, wherein a back arcuate surface of said tube member between said V-shaped notches extends downwardly a greater distance than does a front arcuate surface of said tube member.

6. The apparatus according to claim 1, wherein said means for compressing comprises an actuating arm pivotally mounted with respect to said framework, said actuating arm having an impact portion aligned to contact an end portion of said tubular section on a side of said tubular section adjacent said supply section, when said actuating arm is pivoted toward said pouch.

7. The apparatus according to claim 6, wherein the impact portion and the check valve actuator are formed as an integral piece.

8. The apparatus according to claim 1, wherein said lever arms comprise pins, said engagement formations comprise engagement holes, and said check valve actuator comprises access holes arranged adjacent said cam surfaces, in alignment with said lever arms, said access holes receiving said lever arms therein during compression of said tubular section by said means for selectively compressing.

9. The apparatus according to claim 1, wherein said two lever arms comprise two pins each extending at a distal end portion through said engagement formations, said pins each pivotably connected at a middle portion thereof with respect to said framework, and a spring attached under tension to adjacent base ends of said pins, said spring causing said base ends to be biased toward each other, and said distal end portions to be biased away from each other.

10. An apparatus for dispensing incremental liquid portions from a liquid reservoir comprising:

a pouch having a liquid supply section, a tubular section fluidly connected to said liquid supply section, and a discharge nozzle section fluidly connected to said tubular section, said discharge nozzle section having an aperture at a terminal end thereof, said tubular section comprising a film sleeve along its length, sealed to said liquid supply section, and a tube member held coaxially with said sleeve along a length of said tube member, said tube member having sufficient thickness to have structural memory to spring back after being at least partially collapsed in a radial direction with respect to the cross section of the tube member;

a framework having means for supporting the pouch; and means for selectively compressing said tubular section to at least partially collapse said tube member in the radial direction to dispense said incremental liquid portion.

11. An apparatus for dispensing incremental liquid portions from a liquid reservoir comprising:

a pouch having a liquid supply section, a tubular section fluidly connected to said liquid supply section, and a discharge nozzle section fluidly connected to said tubular section, said discharge nozzle section having an aperture at a terminal end thereof, said tubular section having sufficient thickness to have structural memory to spring back after being at least partially collapsed;

a framework having means for supporting the pouch; and means for selectively compressing said tubular section to at least partially collapse said tubular section to dispense said incremental liquid portion;

wherein said tubular section provides a tube member arranged along at least a partial length thereof having two V-shaped notches at a top end thereof arranged on lateral sides of said tubular section allowing said tubular section to be collapsed at its top end by said means for selectively compressing.

12. The apparatus according to claim 11, wherein said two V-shaped notches comprise an included angle of 60° each.

13. An apparatus for dispensing incremental liquid portions from a liquid reservoir comprising:

a pouch having a liquid supply section, a tubular section fluidly connected to said liquid supply section, and a discharge nozzle section fluidly connected to said tubular section, said discharge nozzle section having an aperture at a terminal end thereof, said tubular section having sufficient thickness to have structural memory to spring back after being at least partially collapsed;

a framework having means for supporting the pouch; and means for selectively compressing said tubular section to at least partially collapse said tubular section to dispense said incremental liquid portion;

wherein said tubular section provides a tube member arranged along at least a partial length thereof, having two slits at a top end thereof arranged on lateral sides of said tubular section allowing said tubular section to be collapsed at its top end by said means for selectively compressing.

14. An apparatus for dispensing incremental liquid portions for a liquid reservoir comprising:

a pouch having a liquid supply section, a tubular section fluidly connected to said liquid supply section, and a discharge nozzle section fluidly connected to said tubular section, said discharge nozzle section having an aperture at a terminal end thereof;

said tubular section comprises along its length a liquid holding sleeve and a tube member, said liquid holding sleeve mounted coaxially with said tube member, said tube member having sufficient thickness to retain a structural memory to spring back after being collapsed;

a framework having means for supporting the pouch;

an actuating arm pivotally mounted with respect to said framework, said actuating arm having an impact portion having a first arcuate convex surface aligned to contact an end portion of said tubular section on a side of said tubular section adjacent said supply section when said actuating arm is pivoted toward the pouch, wherein said framework provides a raised anvil portion having a second arcuate convex surface aligned with the contacting of said impact portion against said tubular section, said impact portion squeezing said tubular section against said anvil portion during pivoting of said actuating arm.

15. The apparatus according to claim 14, wherein said framework comprises a front cover member having a window therethrough; and an actuating button providing a finger pushing surface outside said front cover member and mechanically communicating inwardly of said front cover member to said actuating arm, pushing by user of said actuating button causing pivoting of said actuating arm and dispensing of the liquid.

16. An apparatus for dispensing incremental liquid portions for a liquid reservoir comprising:

a pouch having a liquid supply section, a tubular section flow connected to said liquid supply section, and a discharge nozzle section flow connected to said tubular section, said discharge nozzle section having an aperture at a terminal end thereof;

a framework having means for supporting the pouch;

an actuating arm pivotally mounted with respect to said framework, said actuating arm having an impact portion aligned to contact an end portion of said tubular section on a side of said tubular section adjacent said supply section when said actuating arm is pivoted toward the pouch, wherein said framework provides a raised anvil portion aligned with the contacting of said impact portion against said tubular section, said impact portion squeezing said tubular section against said anvil portion during pivoting of said actuating arm;

wherein said tubular section has a tube member arranged along at least a partial length thereof, having cut out portions arranged on opposite lateral sides at a top portion thereof.

17. A liquid dispenser comprising:

a film pouch having a liquid reservoir section, a tubular pump section fluidly connected to said liquid reservoir section, and a discharge nozzle section fluidly connected to said tubular pump section, said discharge nozzle section having an aperture at a terminal end thereof;

a housing having means for supporting the pouch;

an actuating arm pivotally mounted with respect to said housing, said actuating arm having an impact portion aligned to land on an end portion of said tubular pump section to at least partially collapse said end portion, said end portion on a side of said tubular pump section adjacent said reservoir section, when said actuating arm is pivoted toward the pouch; and said tubular pump section comprises a liquid holding film sleeve sealed to said reservoir section, and a tube member, said liquid holding film sleeve mounted coaxially with said tube member, along a length of said tube member, said tube member having sufficient thickness to retain a structural memory to spring back after being collapsed in a radial direction with respect to a cross section of the tube member by said impact portion.

18. A liquid dispenser comprising:

a film pouch having a liquid reservoir section, a tubular pump section fluidly connected to said liquid reservoir section, and a discharge nozzle section fluidly connected to said tubular pump section, said discharge nozzle section having an aperture at a terminal end thereof;

a housing having means for supporting the pouch;

an actuating arm pivotally mounted with respect to said housing, said actuating arm having an impact portion aligned to land on an end portion of said tubular pump section to at least partially collapse said end portion, said end portion on a side of said tubular pump section adjacent said reservoir section, when said actuating arm is pivoted toward the pouch; and said tubular pump section comprises along its length a liquid holding sleeve, and a tube member, said liquid holding sleeve mounted coaxially with a tube member, said tube member having sufficient thickness to retain a structural memory to spring back after being collapsed by said impact portion;

wherein said tube member provides two V-shaped notches at said end portion, said V-shaped notches arranged on lateral sides of said tube member.

19. The liquid dispenser according to claim 18, wherein said V-shaped notches comprise an included angle of 60° each.

20. A liquid dispenser comprising:

a film pouch having a liquid reservoir section, a tubular pump section fluidly connected to said reservoir section, and a discharge nozzle section fluidly connected to said tubular pump section, said discharge nozzle section having an aperture at a terminal end thereof;

a housing having means for supporting the pouch;

an actuating arm pivotally mounted with respect to said housing, said actuating arm having an impact portion aligned to land on an end portion of said tubular pump section to at least partially collapse said end portion, said end portion on a side of said tubular pump section adjacent said reservoir section, when said actuating arm is pivoted toward the pouch; and said tubular pump section comprises along its length a liquid holding sleeve and a tube member, said liquid holding sleeve mounted coaxially with said tube member, said tube member having sufficient thickness to retain a structural memory to spring back after being collapsed by said impact portion;

wherein said tube member comprises two V-shaped notches arranged on lateral sides of said tube member at an opposite end to said end portion.

21. The liquid dispenser according to claim 20 further comprising a lower check valve mounted with respect to said housing and having two lever arms arranged laterally spaced apart, each lever arm engageable to said discharge nozzle section of said pouch on opposite sides of said aperture, said lever arms biased away from each other to stretch flat said discharge nozzle section for closure of said aperture; and a check valve actuator, mounted for movement with said actuating arm, said check valve actuator having two sloped surfaces each arranged to impact one of said lever arms respectively, pivoting of said actuating arm toward said pouch engages said sloped surfaces against said lever arms to force said lever arms toward each other to relax said aperture.

22. The liquid dispenser according to claim 20, wherein one arcuate section of the tube member, separated from a respective other arcuate section by said V-shaped notches is axially longer than said respective other arcuate section.

23. A liquid dispenser comprising:

a film pouch having a liquid reservoir section, a tubular pump section fluidly connected to said liquid reservoir section, and a discharge nozzle section fluidly connected to said tubular pump section, said discharge nozzle section having an aperture at a terminal end thereof;

a housing having means for supporting the pouch;

an actuating arm pivotally mounted with respect to said housing, said actuating arm having an impact portion aligned to land on an end portion of said tubular pump section to at least partially collapse said end portion, said end portion on a side of said tubular pump section adjacent said reservoir section, when said actuating arm is pivoted toward the pouch; and said tubular pump section comprises along its length a liquid holding sleeve and a tube member, said liquid holding sleeve mounted coaxially with said tube member, said tube member having sufficient thickness to retain a structural memory to spring back after being collapsed by said impact portion;

wherein the tube member provides axially extending slits arranged on lateral sides of said tube member at said end portion.

24. For an apparatus which holds a liquid filled pouch for dispensing incremental liquid portions from the pouch and having a framework to support the pouch and means for squeezing a portion of the pouch to dispense liquid therefrom, an improved pouch comprising:

a liquid reservoir section, a tubular section fluidly connected to said liquid reservoir section, and a discharge nozzle section fluidly connected to said tubular section, said liquid reservoir section extending downwardly into said tubular section, said discharge nozzle section having an aperture at a terminal end thereof, said tubular section comprising a film sleeve along its length, sealed to said liquid reservoir section and a tube member held coaxially within said sleeve, said tube member having sufficient thickness to have structural memory to spring back after being at least partially collapsed in a radial direction with respect to a cross section of the tube member by said means for squeezing.

25. For an apparatus which holds a liquid filled pouch for dispensing incremental liquid portions from the pouch and having a framework to support the pouch and means for squeezing a portion of the pouch to dispense liquid therefrom, an improved pouch comprising:

a liquid reservoir section, a tubular section fluidly connected to said liquid reservoir section, and a discharge nozzle section fluidly connected to said tubular section, said liquid reservoir section extending downwardly into said tubular section, said discharge nozzle section having an aperture at a terminal end thereof, said tubular section comprising a film sleeve along its length, sealed to said liquid reservoir section and a tube member held coaxially within said sleeve, said tube member having sufficient thickness to have structural memory to spring back after being at least partially collapsed by said means for squeezing;

wherein said tube member comprises a pair of V-shaped notches arranged at a bottom end thereof, arranged on opposite lateral sides.

26. For an apparatus which holds a liquid filled pouch for dispensing incremental liquid portions from the pouch and having a framework to support the pouch and means for squeezing a portion of the pouch to dispense liquid therefrom, an improved pouch comprising:

a liquid reservoir section, a tubular section fluidly connected to said liquid reservoir section, and a discharge nozzle section fluidly connected to said tubular section, said liquid reservoir section extending downwardly into said tubular section, said discharge nozzle section having an aperture at a terminal end thereof, said tubular section comprising a film sleeve along its length, sealed to said liquid reservoir section and a tube member held coaxially within said sleeve, said tube member having sufficient thickness to have structural memory to spring back after being at least partially collapsed by said means for squeezing;

wherein said tube member provides two slits at a top end thereof arranged on lateral sides of said tube member allowing said tube member to be collapsed at its top end by said means for squeezing.

27. For an apparatus which holds a liquid filled pouch for dispensing incremental liquid portions from the pouch and having a framework to support the pouch and means for squeezing a portion of the pouch to dispense liquid therefrom, an improved pouch comprising:

a liquid reservoir section, a tubular section fluidly connected to said liquid reservoir section, and a discharge nozzle section fluidly connected to said tubular section, said liquid reservoir section extending downwardly into said tubular section, said discharge nozzle section having an aperture at a terminal end thereof, said tubular section comprising a film sleeve along its length, sealed to said liquid reservoir section and a tube member held coaxially within said sleeve, said tube member having sufficient thickness to have structural memory to spring back after being at least partially collapsed by said means for squeezing;

wherein said discharge nozzle section provides holes located on opposite sides of said aperture, said holes for engagement by said apparatus to open and close said aperture.

* * * * *